US006542714B1

(12) United States Patent
Hatakeyama

(10) Patent No.: US 6,542,714 B1
(45) Date of Patent: Apr. 1, 2003

(54) IMAGE FORMING METHOD AND APPARATUS THAT USES AN EXTERNAL SHEET DISCHARGE TRAY FOR DOUBLE-SIDE COPYING

(75) Inventor: Takashi Hatakeyama, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/989,015

(22) Filed: Nov. 21, 2001

(51) Int. Cl.[7] ..... G03G 15/00
(52) U.S. Cl. ..... 399/401; 399/402; 399/405
(58) Field of Search ..... 399/364, 373, 399/374, 393, 401, 402, 405; 271/3.01, 3.03, 287, 301

(56) References Cited

U.S. PATENT DOCUMENTS 4,748,470 A * 5/1988 Ibuchi ..... 399/402

FOREIGN PATENT DOCUMENTS

JP 7-22673 5/1995

* cited by examiner

*Primary Examiner*—Hoang Ngo
(74) *Attorney, Agent, or Firm*—Foley & Lardner

(57) ABSTRACT

After a printer section is used to form an image on one surface of a sheet, the sheet is once discharged into a sheet discharge tray disposed outside an apparatus main body. Thereafter, the sheet is supplied into the apparatus main body, and the printer section is used to form an image on the other surface of the sheet. The sheet having the opposite surfaces printed in this manner is discharged to an upper portion of the sheet discharge tray. It is unnecessary to dispose a conventional stack cassette for reversing the sheet and a sheet conveyance path having sharp corners inside the apparatus main body.

14 Claims, 17 Drawing Sheets

IMAGE FORMING METHOD AND APPARATUS THAT USES AN EXTERNAL SHEET DISCHARGE TRAY FOR DOUBLE-SIDE COPYING

BACKGROUND OF THE INVENTION

The present invention relates to image forming apparatuses such as a both-surfaces copying machine for forming images on opposite surfaces of a sheet.

FIG. 16 shows a constitution of a conventional copying machine, that is, an image forming apparatus. In a copying machine 1, a sheet reversing section 200 for reversing a sheet 100 necessary for both-surfaces copying, and a stack cassette 300 for the both-surfaces copying are disposed. The stack cassette 300 is a storage section for temporarily storing the reversed sheet after an image is formed on one surface of the sheet during the both-surfaces copying.

An operation for the both-surfaces copying will be described below. When a copy button is depressed, the sheet 100 is supplied from a cassette 90, and guided to a photosensitive body 10 through a conveyance path 240. A toner image formed on the photosensitive body 10 is transferred to the sheet 100, and fixed onto the sheet 100 by a fixing unit 80. Thereafter, the sheet passes through a conveyance path 250, is then reversed by the sheet reversing section 200, and enters the stack cassette 300 for the both-surfaces copying.

When a desired number of sheets 100 are all taken in, the sheet 100 is taken out of the stack cassette 300, passed through a conveyance path 260, and fed to the photosensitive body 10. The toner image formed on the photosensitive body 10 is transferred onto a non-copied side of the sheet 100, and fixed onto the sheet by the fixing unit 80, and the sheet 100 having the opposite surfaces copied is discharged to a sheet discharge tray 2.

This constitution has the following problems.

Firstly, since the sheet reversing section 200 and stack cassette 300 for the both-surfaces copying are disposed in the apparatus, the entire apparatus has a large size.

Secondly, when the sheet is reversed, the sheet is passed through sharp corners (arrows 200*a*, 250*a* in the drawing) in the conveyance path of the sheet reversing section 200. Therefore, the sheet is bent, the load on the sheet being conveyed is enlarged, and a jam easily occurs.

BRIEF SUMMARY OF THE INVENTION

An object of the present invention is to provide an image forming apparatus in which a jam in a conveyance path for reversing a sheet during both-surfaces copying is inhibited from occurring and in which the both-surfaces copying is enabled with a size of the entire apparatus being as small as possible.

In order to achieve the above object, according to one aspect of the present invention, there is provided an image forming apparatus including an apparatus main body having an image forming section, and a sheet discharge tray disposed outside the apparatus main body, the apparatus comprising: first image forming means which uses the image forming section to form an image on one surface of a sheet; a sheet discharge section for discharging the sheet with the image formed thereon by the first image forming means to the sheet discharge tray; a sheet supply section for supplying the sheet discharged to the sheet discharge tray by the sheet discharge section into the apparatus main body; and second image forming means which uses the image forming section to form an image on the other surface of the sheet supplied to the sheet supply section.

The sheet having the image formed on one surface thereof by the image forming section is discharged to the sheet discharge tray outside the apparatus. Thereafter, the sheet is supplied into the apparatus, and the image is formed on the other surface of the sheet by the image forming section. The image forming apparatus of the present invention does not include a stack cassette for both-surfaces copying and a sheet conveyance path having sharp corners inside the apparatus.

DETAILED DESCRIPTION OF THE PREFERRED EMBODIMENTS

Figure 1:
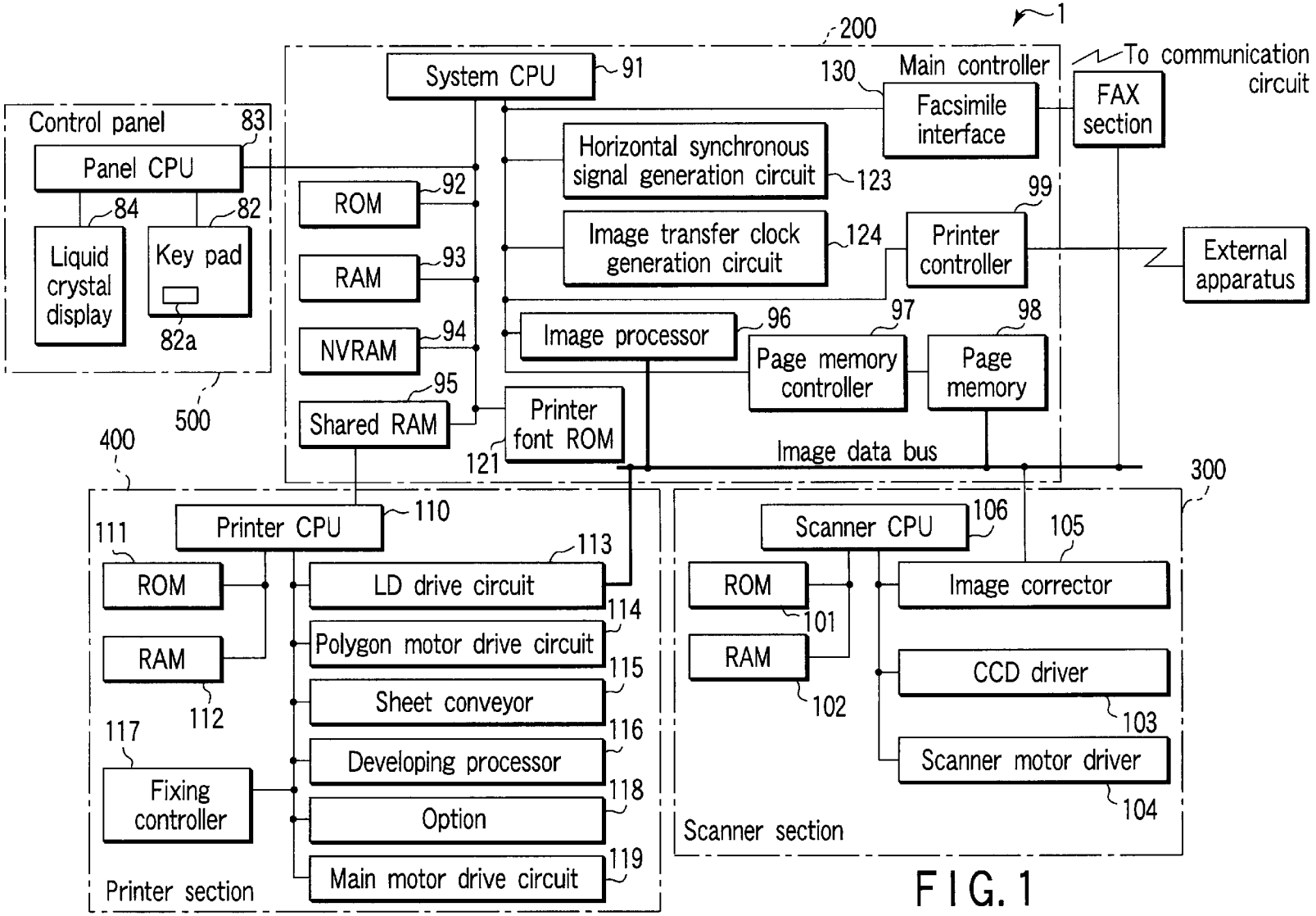
FIG. 1 is a block diagram schematically showing a constitution of a control system of a digital copying machine to which the present invention is applied.

FIG. 1 is a block diagram schematically showing a constitution of a control system of a digital copying machine (image forming apparatus) to which the present invention is applied.

A digital copying machine 1 is constituted of a main controller 200 controlled by a system CPU 91, a scanner section 300 controlled by a scanner CPU 106, a printer section 400 controlled by a printer CPU 110, and a control panel 500 controlled by a panel CPU 83.

The main controller 200 is constituted of the system CPU 91, a ROM 92, a RAM 93, a NVRAM 94, a shared RAM 95, an image forming section 96, a page memory controller 97, a page memory 98, a printer font ROM 121, a horizontal synchronous signal generation circuit 123, an image transfer clock generation circuit 124, and a facsimile interface 130.

Various control programs including the present invention are stored in the ROM 92. The system CPU 91 uses the RAM 93 as an operation area, and controls the whole main controller 200 in accordance with the control program stored in the ROM 92. The system CPU 91 transmits operation instructions to the printer 400 (printer CPU 110) and scanner 30*b* (scanner CPU 106), and the printer 400 and scanner 300 return a status to the system CPU 91.

The NVRAM (nonvolatile RAM) 94 is a nonvolatile memory backed up by a battery (not shown), and holds data on the NVRAM 94 when power is cut. Moreover, the NVRAM 94 stores a default value (initial set value) with respect to a hardware element which has a copying (PPC) function, FAX function, and the like. The shared RAM 95 is used to perform bidirectional communication between the system CPU 91 and the printer CPU 110.

The image processor 96 subjects image data input from the scanner section 300, and the like to image processing such as a screen processing, trimming, and masking. In the printer font ROM 121, font data corresponding to code data such as character codes is stored.

A printer controller 99 receives the code data such as character codes from external apparatuses such as a personal computer via LAN. The printer controller 99 uses font data stored in the printer font ROM 121 to develop the code data into image data with a size and resolution in accordance with data indicating character size and resolution given to the code data, and stores the image data in the page memory 98.

The horizontal synchronous signal generation circuit 123 generates a horizontal synchronous signal synchronized with rotation of a polygon mirror which scans a laser beam for forming the image in a main scanning direction. The image transfer clock generation circuit 124 generates an image transfer clock which controls a timing for transferring image data to a semiconductor laser for forming the image.

The page memory controller 97 stores or reads the image data with respect to the page memory 98. The page memory 98 has a region in which the image data, for example, for two pages can be stored. The memory is constituted so that data constituted by compressing the image data from the scanner section 300 or the printer controller 99 can be stored for each page.

The control panel 500 includes the panel CPU 83, a liquid crystal display 84, and a keypad 82. The keypad 82 includes not only a copy button 82*a* for instructing copy operation start but also various setting buttons for setting a magnification, the number of copies, and the like. The liquid crystal display 84 displays copying conditions including conditions set using the keypad 82. The panel CPU 83 controls the liquid crystal display 84 and keypad 82, and transmits the set conditions and copy start instruction to the system CPU 91.

The printer section 400 includes the printer CPU 110, a ROM 111, a RAM 112, an LD drive circuit 113, a polygon motor drive circuit 114, a sheet conveyor 115, a developing processor 116, a fixing controller 117, an option section 118, and a main motor drive circuit 119.

The printer CPU 110 generally controls the operation of the printer section 400 in accordance with the operation instruction of the system CPU 91. The ROM 111 stores the control program including the present invention, and the RAM 112 is used for temporarily storing the data. The LD drive circuit 113 controls on/off emission by the semiconductor laser, and the polygon motor drive circuit 114 controls rotation of a polygon motor which rotates the polygon mirror.

The sheet conveyor 115 controls conveyance of a sheet by the conveyance path, and the developing processor 116 controls charging, developing, and transfer processings of a photosensitive drum. The fixing controller 117 controls a fixing unit for fixing a toner image to the sheet, and the main motor drive circuit 119 controls rotation o f a ma in motor which rotates the photosensitive drum, a developing roller in a developing unit, and the like.

The scanner section 300 includes the scanner CPU 106, a ROM 101, a RAM 102, a CCD driver 103, a scanner motor driver 104, and an image corrector 105.

The scanner CPU 106 entirely controls the scanner section 300 in accordance with the operation instruction of the system CPU 91. The ROM 101 stores the control program, and the like, and the RAM 102 is used for temporarily storing the data. The CCD driver 103 drives a CCD sensor which converts a reflected light from a document sheet to an analog electrical signal. The scanner motor driver 104 controls an exposure lamp for lighting the document sheet, and rotation of a driving motor for moving a carriage which scans the document sheet in a sub-scanning direction. The image corrector 105 includes an analog-to-digital conversion circuit for converting the analog signal from a CCD sensor to a digital signal, and a shading correction circuit for correcting an output fluctuation of the CCD sensor attributed to a sensitivity dispersion of the CCD sensor or an ambient temperature change.

Figure 2:
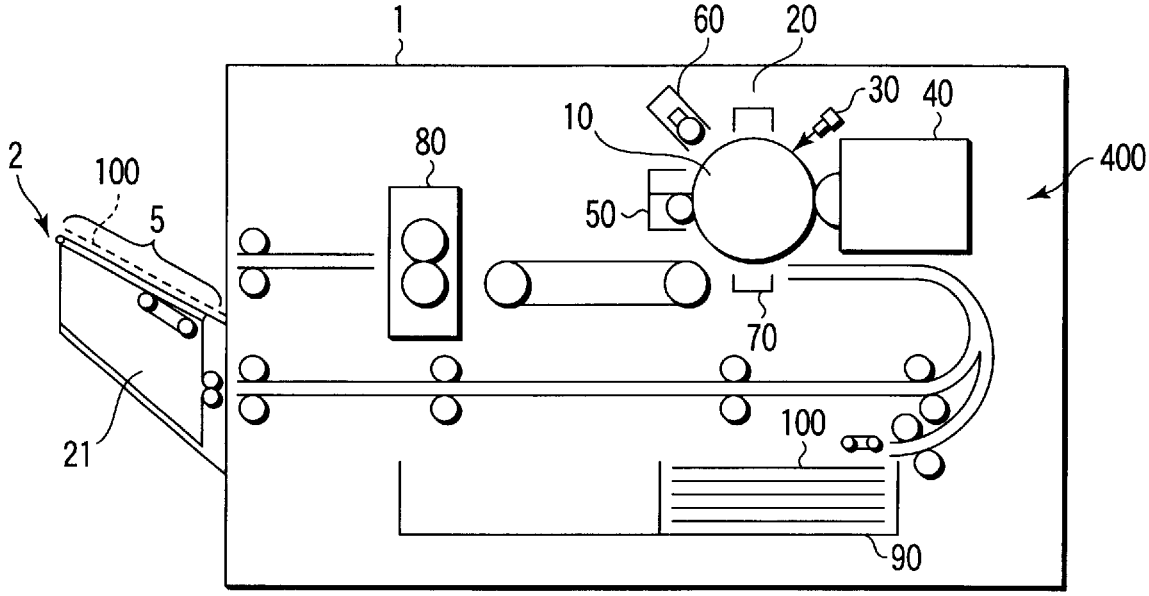
FIG. 2 is a diagram schematically showing a structure of the copying machine according to the present invention.

FIG. 2 is a diagram schematically showing a structure of the copying machine 1 according to the present invention. As shown in FIG. 1, the digital copying machine 1 of the present invention includes the scanner section 300 for reading a document image and providing the image data corresponding to the document image, and the printer section 400 for forming the image on the sheet based on the image data from the scanner section 300. FIG. 2 is a diagram mainly showing the constitution of the printer section 400, and the constitution of the scanner section 300 is omitted for simplicity of description.

In the printer section 400, a photosensitive drum (hereinafter referred to simply as the photosensitive body) 10, a charging unit 20 for charging the photo-sensitive body 10, an exposing device 30 for forming an electrostatic latent image, a developing unit 40 for developing the electrostatic latent image, a cleaner 50 for removing a residual toner on the photosensitive body 10, a discharger 60 for discharging the surface of the photosensitive body 10, a transferring device 70 for transferring the toner image to a sheet 100 from the photosensitive body 10, a fixing unit 80 for fixing the transferred toner image to the sheet 100, a cassette 90 for storing the sheet 100, and a sheet discharge tray 2 are arranged.

Figure 3:
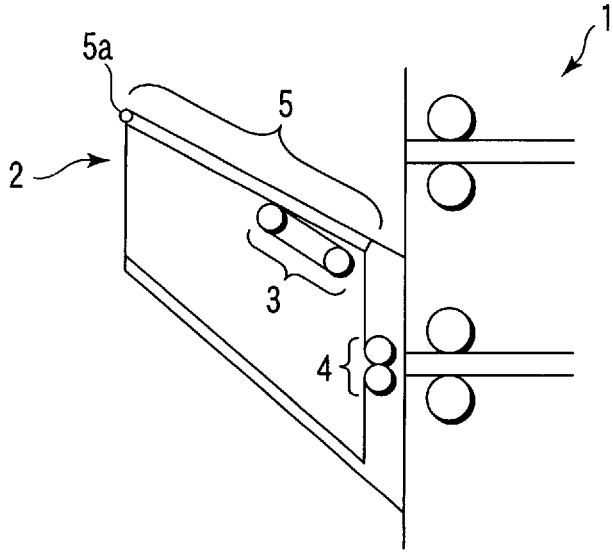
FIG. 3 is an enlarged view showing a structure of a sheet discharge tray 2 and a copying machine main body in the vicinity of the tray.

FIG. 3 is an enlarged view showing a structure of the sheet discharge tray 2 and a copying machine main body in the vicinity of the tray according to a first embodiment of the present invention. In the sheet discharge tray 2 a pickup roller 3 and separating roller 4 for supplying the sheets 100 on a sheet by sheet basis are disposed, and an upper portion 5 rotates centering on a shaft 5*a*, and also functions as a lid of a sheet storage section 21.

Figure 4A:
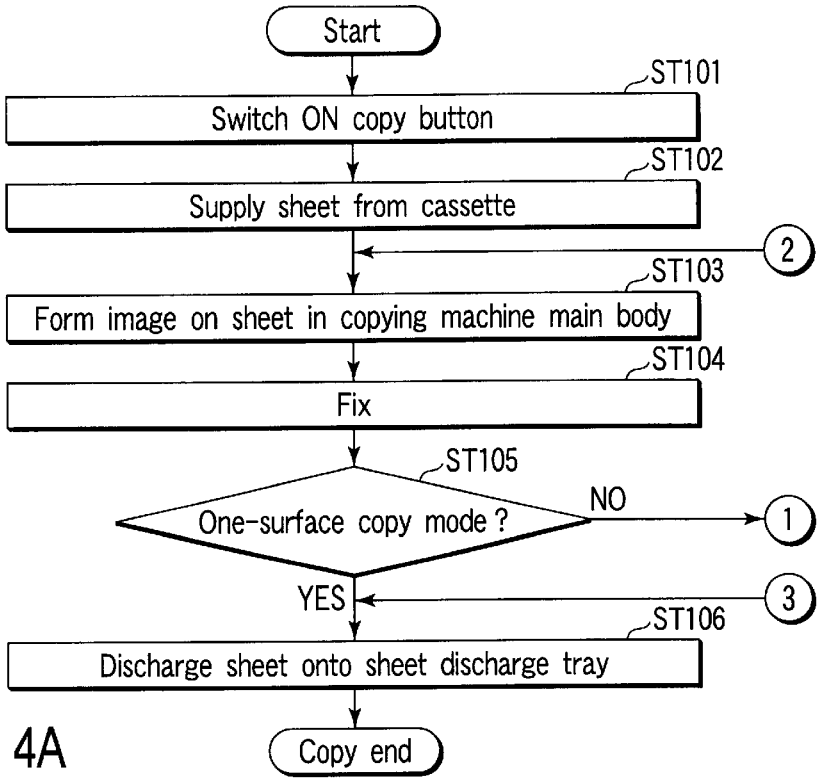
FIGS. 4A, 4B are flowcharts showing an operation for usual copying and an operation of the sheet discharge tray 2 for both-surfaces copying.

An operation of the copying machine 1 according to the first embodiment will be described hereinafter. First, the operation for usual copying (in a one-surface mode) will be described with reference to a flowchart shown in FIG. 4A. Additionally, operations of a plurality of embodiments according to the present invention shown hereinafter are controlled by the printer CPU 110 in response to the operation instruction of the system CPU 92. However, these operations may be controlled by the system CPU 92 in other systems.

When a copy button 82*a* disposed in the control panel 500 is depressed (ST101), a copy start instruction is transmitted to the printer CPU 110 via the system CPU 91. The printer CPU 110 gives the operation instruction to each component which constitutes the printer section 400. As a result, the surface of the photosensitive body 10 is uniformly charged by the charging unit 20, and exposed to light by the exposing device 30 in accordance with the image data, so that an electrostatic latent image is formed on the photosensitive body 10.

The latent image on the photosensitive body 10 is developed by the developing unit 40, and the toner image is formed. Moreover, the sheets 100 are supplied from the cassette 90 sheet by sheet so as to position the sheet 100 and the toner image (ST102), and guided into the photosensitive body 10. Moreover, the toner image formed on the photosensitive body 10 is electrostatically transferred to the conveyed sheet by the transferring device 70 (ST103), and fixed onto the sheet 100 by thermal pressing by the fixing unit 80 (ST104). The sheet 100 is then discharged to the sheet discharge tray 2 (ST106). In this case, the upper portion 5 of the sheet discharge tray 2 is closed, and the sheet 100 rides on the sheet discharge tray 2 as shown by a broken line of FIG. 2. Moreover, for the photosensitive body 10 from which the toner image has been transferred to the sheet 100, the residual toner is cleaned by the cleaner 50, and the photosensitive body is irradiated with light from the discharger 60, thereby discharged , and prepared for the next charging.

An operation for both-surfaces copying (in a both-surfaces mode) according to the present invention will next be described. FIG. 4 is a flowchart showing the operation of the sheet discharge tray 2 for the both-surfaces copying, and FIG. 5 is a sectional view of the copying machine 1. Left views of FIG. 5 are enlarged views showing a structure of the sheet discharge tray 2 and the copying machine main body in the vicinity of the tray.

When the copy button is depressed, the sheets 100 are supplied from the cassette 90 sheet by sheet so as to be positioned with the toner image formed on the photosensitive body 10, and guided to the photosensitive body 10 (ST101 and 102). Moreover, the toner image formed on the photosensitive body 10 is transferred to the sheet 100, and fixed onto the sheet 100 by the fixing unit 80. Then, the sheet 100 is discharged to the sheet discharge tray 2 (ST103, 104). (Since the operation is the same as that of the one-surface mode, detailed description is omitted.)

Figure 5A:
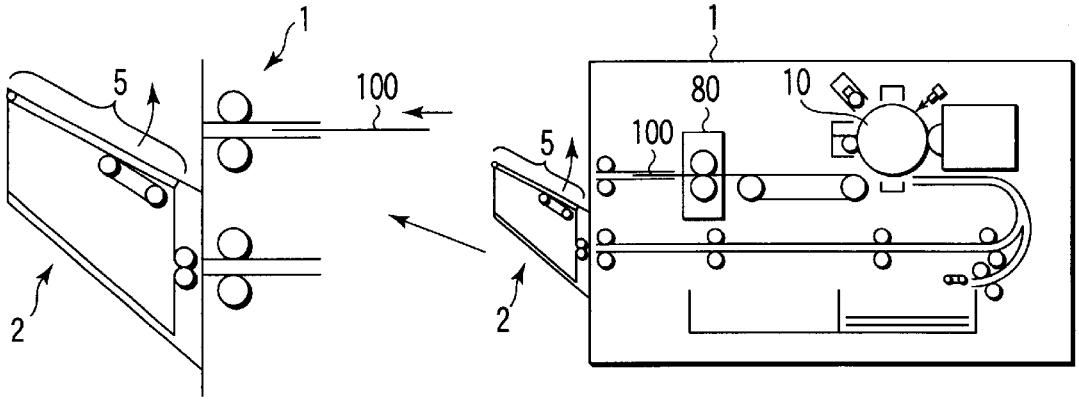
FIGS. 5A to 5E are sectional views of a copying machine 1 according to a first embodiment.
Figure 5B:
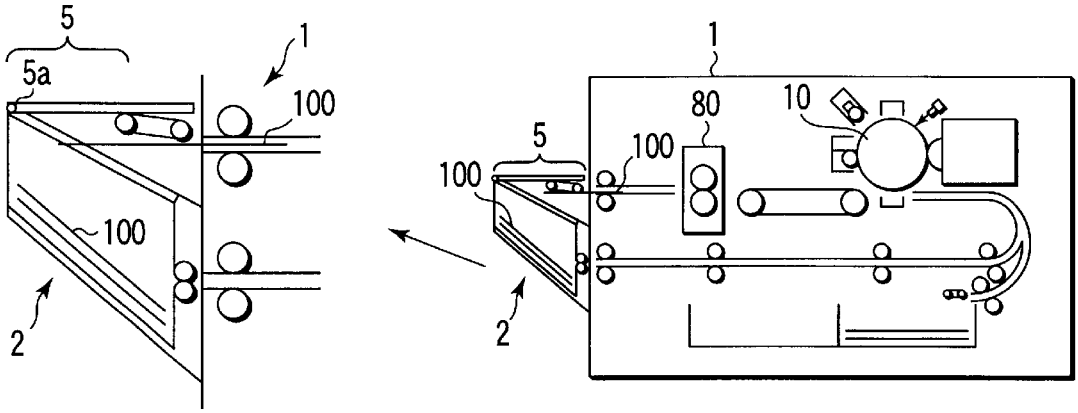
Figure 5C:
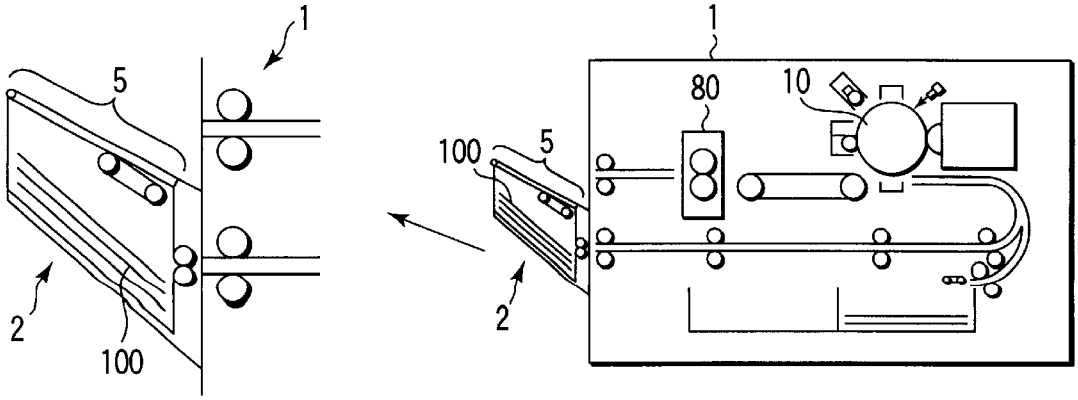
Figure 5D:
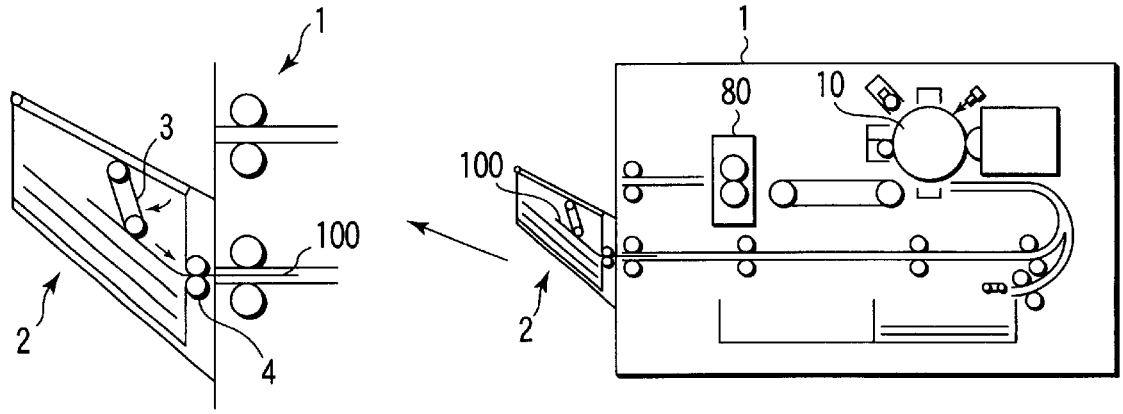

As shown in FIGS. SA and 5B, when the sheet 100 comes immediately before the sheet discharge tray 2, the upper portion 5 of the sheet discharge tray 2 rotates about the shaft 5*a* and opens (ST111), and the sheet 100 is taken in (ST112). When the set sheets 100 are all taken in, the upper portion 5 closes as shown in FIG. 5C (ST113, 114). Moreover, as shown in FIG. 5D, the sheets 100 are fed sheet by sheet into the main body of the copying machine 1 by the pickup roller 3 and separation roller 4 so that the sheet is positioned with the toner image formed on the photosensitive body 10 (ST115).

In this case, according to the present invention, it is unnecessary to dispose sharp corners in the conveyance path in order to reverse the sheet as described in the related art, and therefore the sheet 100 can be fed smoothly to the photosensitive body 10.

Figure 5E:
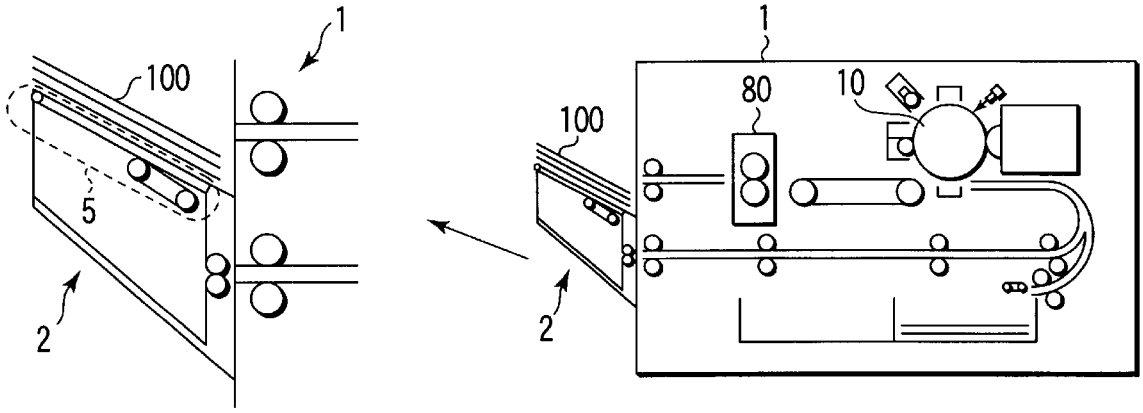

The toner image formed on the photosensitive body 10 is transferred to the non-copied opposite surface of the sheet 100 conveyed to the photosensitive body 10, the toner image is fixed by the fixing unit 80, and the sheet 100 having the opposite surfaces copied is discharged as shown in FIG. 5E. In this case, the upper portion 5 of the sheet discharge tray 2 is closed, and the sheet rides on the sheet discharge tray 2.

As described above, according to the present invention, since a sheet reversing mechanism for reversing the sheet necessary for the both-surfaces copying, and a stack cassette for the both-surfaces copying (cassette for temporarily storing the reversed sheet after the image is formed on one surface during the both-surfaces copying) are not disposed inside the copying machine, the size of the whole copying machine can be reduced.

Moreover, as described above, in the present invention, since a conveyance path for reversing the sheet during sheet reversing (the conveyance path having sharp corners) is not disposed, a the load on the sheet during conveyance is low, a and jam inside the copying machine during the both-surfaces copying does not easily occur as compared with a conventional machine.

A second embodiment of the present invention will next be described.

The structure of the sheet discharge tray 2 is not limited to the structure in which the upper portion of the tray rotates and opens as shown in FIG. 3, and a structure shown in FIG. 6 or FIG. 7 may be used. FIG. 6 shows the second embodiment, and FIG. 7 shows a modification example of the second embodiment. Moreover, FIGS. 6 and 7 are sectional views showing the structure of the sheet discharge tray 2 and copying machine main body in the vicinity of the tray.

Figure 8A:
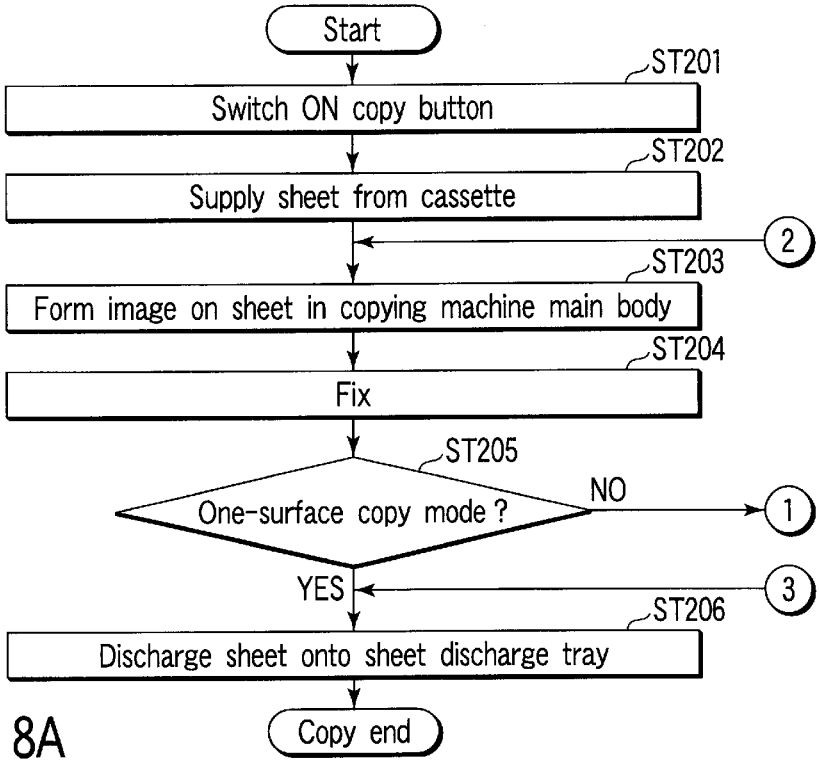
FIGS. 8A, 8B are flowcharts showing the operation of the embodiment shown in FIG. 6.
Figure 8B:
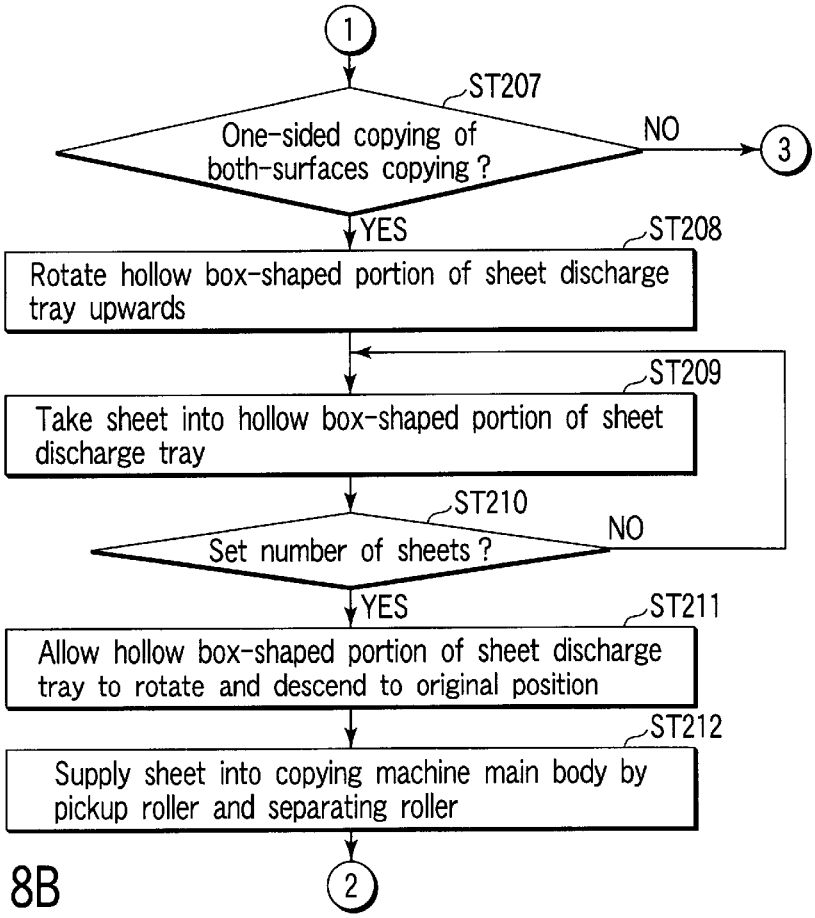

FIG. 8 is a flowchart showing the operation of the embodiment shown in FIG. 6. Since the operation for usual copying (in the one-surface mode) is similar to that of the first embodiment of FIG. 4A, description thereof is omitted. A structure and operation different from those of the first embodiment will be described hereinafter.

Figure 6A:
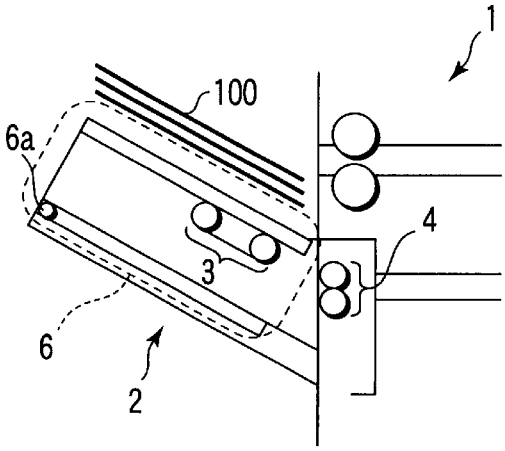
FIGS. 6A, 6B are sectional views showing the structure of the sheet discharge tray and copying machine main body in the vicinity of the tray according to a second embodiment.

In the sheet discharge tray 2 of FIG. 6, the pickup roller 3 and separating roller 4 for supplying the sheets on the sheet by sheet basis are disposed, and a hollow box-shaped portion 6 rotates about a shaft 6*a*. FIG. 6A is a diagram showing a state in which the sheet 100 is discharged onto the sheet discharge tray 2. The sheet discharge tray 2 does not rotate, and the sheet 100 rides on the sheet discharge tray 2.

Figure 6B:
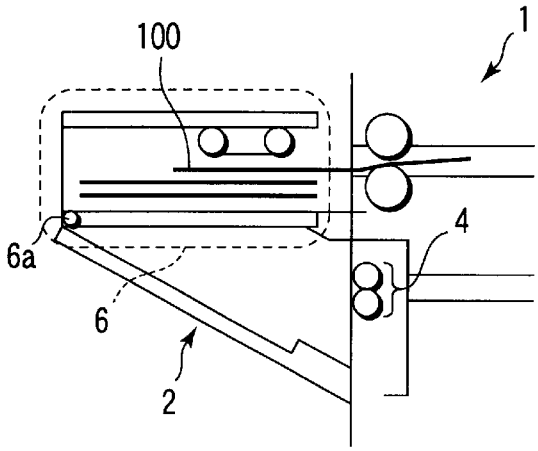

FIG. 6B is a diagram showing a state in which the sheet 100 discharged during the both-surfaces copying is taken in. The hollow box-shaped portion 6 rotates to a position in which the sheet can be taken in, and the sheet 100 is taken in (ST208, 209). When a predetermined number of sheets are taken in, the hollow box-shaped portion 6 of the sheet discharge tray 2 rotates, and descends to an original position shown in FIG. 6A (ST210, 211). Moreover, the sheet is supplied into the copying machine main body by the pickup roller 3 and separating roller 4 (ST212), and the image is formed and fixed (ST203, 204). Thereafter, the sheet is discharged onto the sheet discharge tray 2 as shown in FIG. 6A (ST206).

Figure 7A:
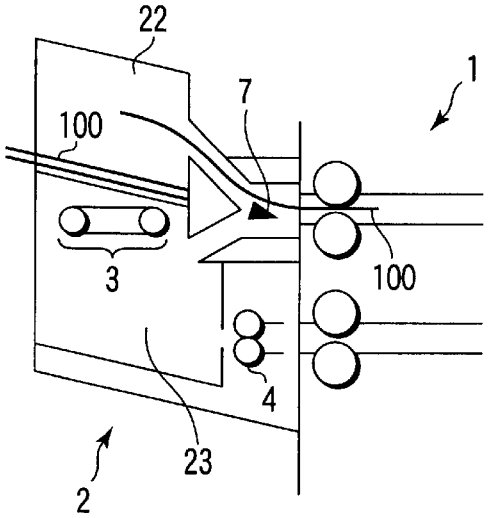
FIGS. 7A, 7B are sectional views showing a structure of the sheet discharge tray and the copying machine main body in the vicinity of the tray according to a modification example of the second embodiment.

The sheet discharge tray 2 of FIG. 7 has a constitution in which upper and lower sheet storage sections 22 and 23, and the pickup roller 3 and separating roller 4 for supplying the sheets on the sheet by sheet basis are disposed, and a guide 7 rotates. FIG. 7A is a diagram showing the state in which the sheet 100 is discharged onto the sheet discharge tray 2.

Figure 9A:
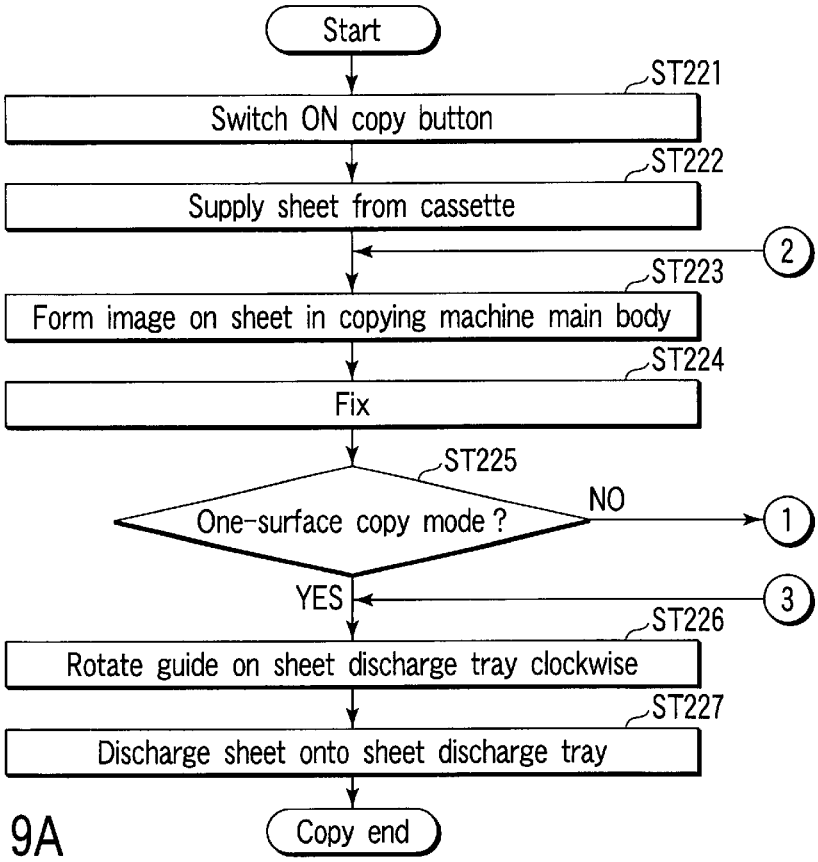
FIGS. 9A, 9B are flowcharts showing the operation of the embodiment shown in FIG. 7.
Figure 9B:
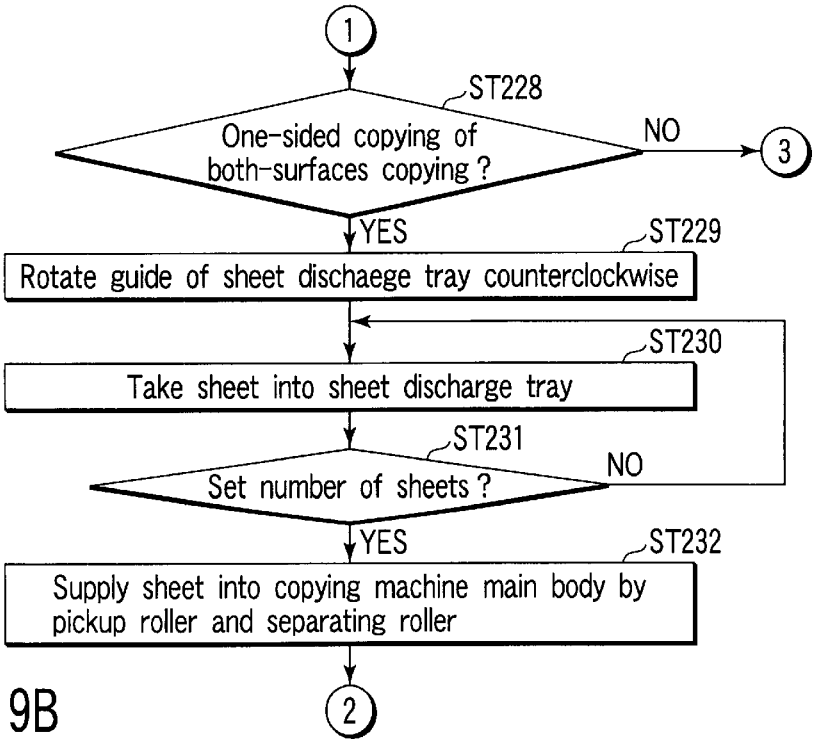

FIG. 9 is a flowchart showing the operation of the embodiment shown in FIG. 7. In the one-surface mode, when the image is formed on one surface of the sheet 100 (ST223, 224), the guide 7 rotates clockwise as shown in FIG. 7A (ST226), and the sheet is guided to the upper storage section 22 of the sheet discharge tray 2 (ST227).

Figure 7B:
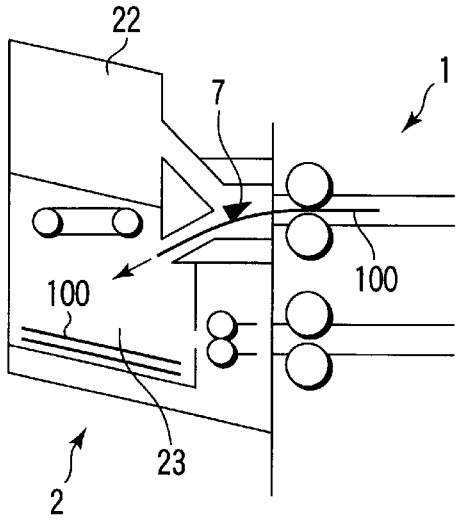

In a both-surfaces mode, when the image is formed on one surface of the sheet 100 (ST223, 224), the guide 7 rotates counterclockwise (ST229), and the sheet 100 is taken into the lower storage section 23 (ST230). FIG. 7B is a diagram showing a state in which the sheet 100 discharged during the both-surfaces copying is taken into the lower storage section 23. When the predetermined number of sheets are taken in, the sheet is supplied into the copying machine main body by the pickup roller 3 and separating roller 4 (ST231, 232), and the image is formed and fixed (ST223, 224). Thereafter, the guide 7 rotates clockwise as shown in FIG. 7A (ST226), and the sheet having the opposite surfaces copied is guided into the upper storage section 22 of the sheet discharge tray 2 (ST227).

Additionally, FIGS. 6A, 7A show the state of the sheet discharge tray 2 for the usual copying (in the one-surface mode) of FIG. 2, or the state of FIG. 5E in the first embodiment. FIGS. 6B, 7B show the state of FIG. 5B in the first embodiment.

A third embodiment of the present invention will next be described.

Figure 10:
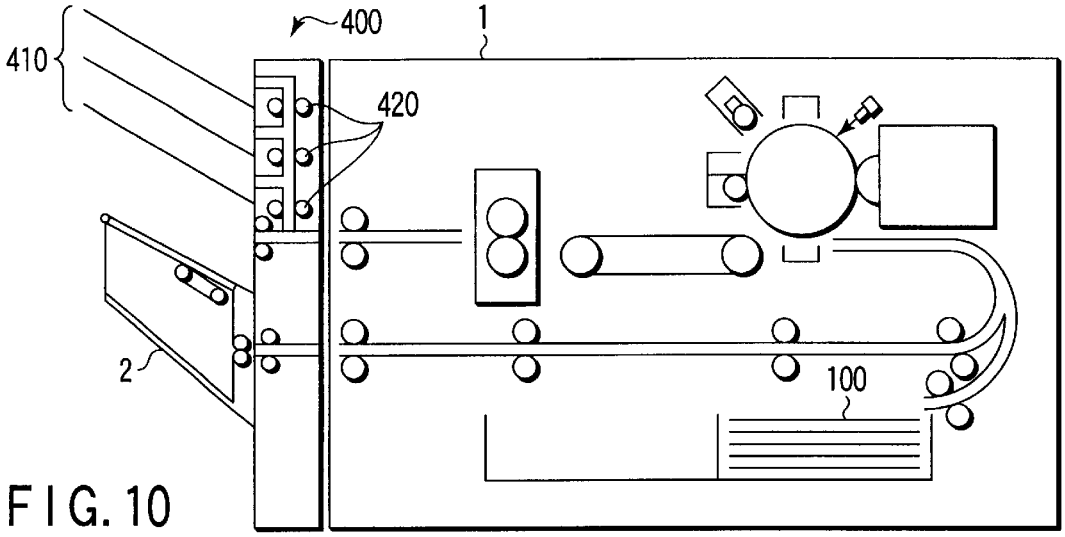
FIG. 10 shows a constitution of the copying machine according to a third embodiment of the present invention.
Figure 11A:
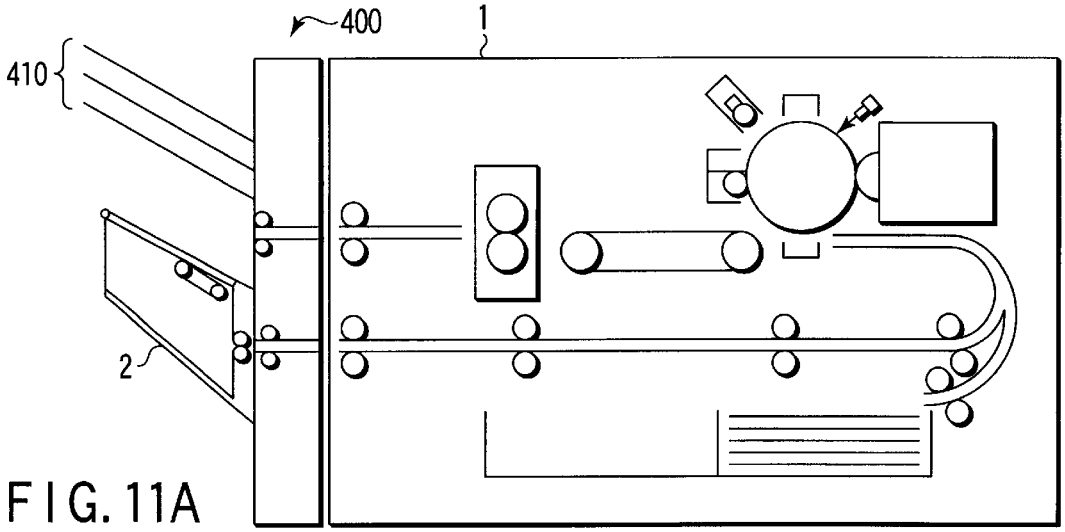
FIGS. 11A, 11B show a constitution of the copying machine according to a modification example of the third embodiment of the present invention.

The sheet discharge tray 2 is not limited to a tray attached to the copying machine main body as shown in FIG. 2, and may have a constitution attached to a sorter (finisher) 400 shown in FIGS. 10, 11. FIG. 10 shows the third embodiment, and FIG. 11 shows a modification example of the third embodiment. Either one is an example in which the same tray as the sheet discharge tray 2 of FIG. 3 is attached to the sorter 400.

Figure 12:
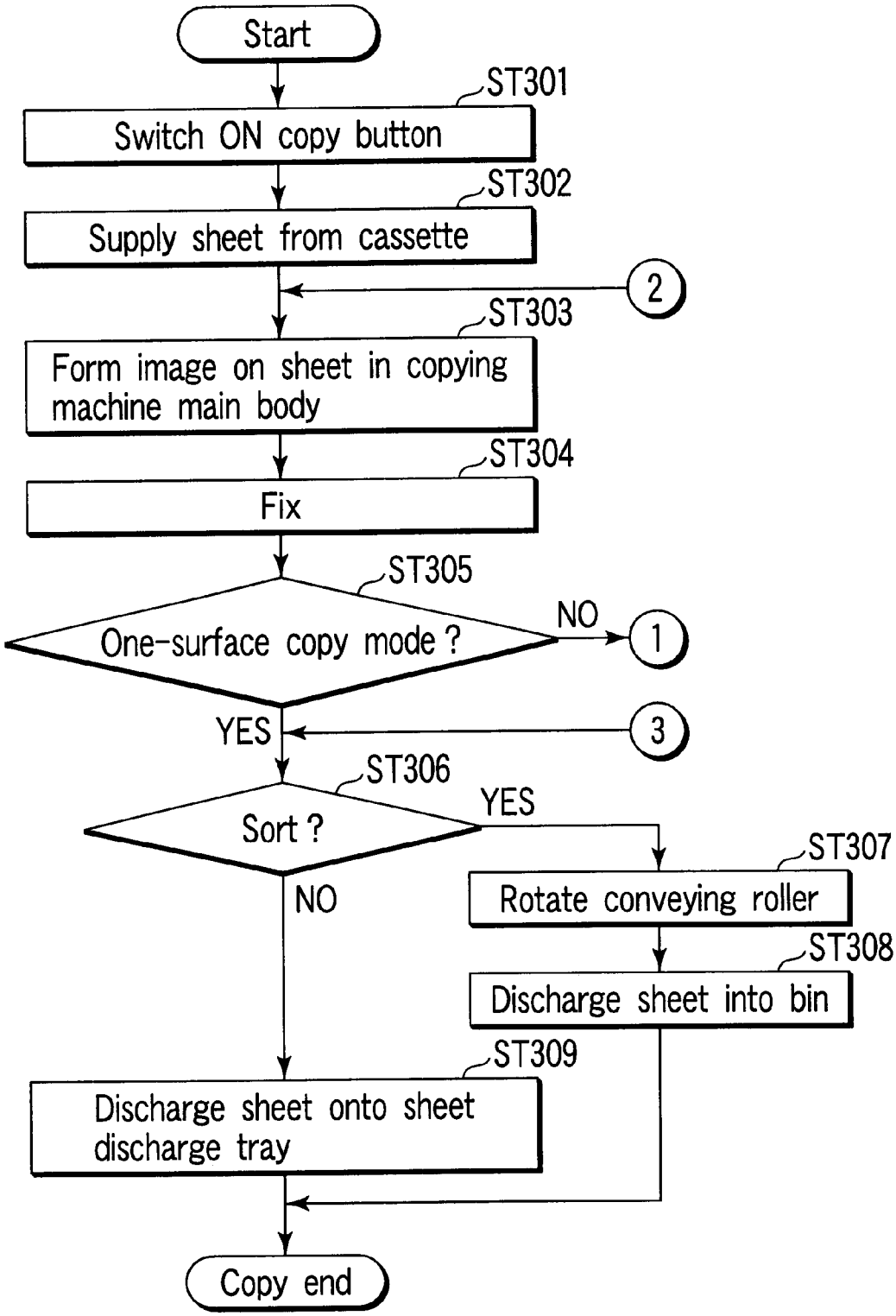
FIG. 12 is a flowchart showing the operation of the apparatus shown in FIG. 10.

The apparatus shown in FIG. 10 shows a constitution in which a bin 410 of the sorter 400 does not move vertically, and a conveying roller 420 guides the sheet 100 to each bin. FIG. 12 is a flowchart showing the operation of the apparatus of FIG. 10.

Figure 4B:
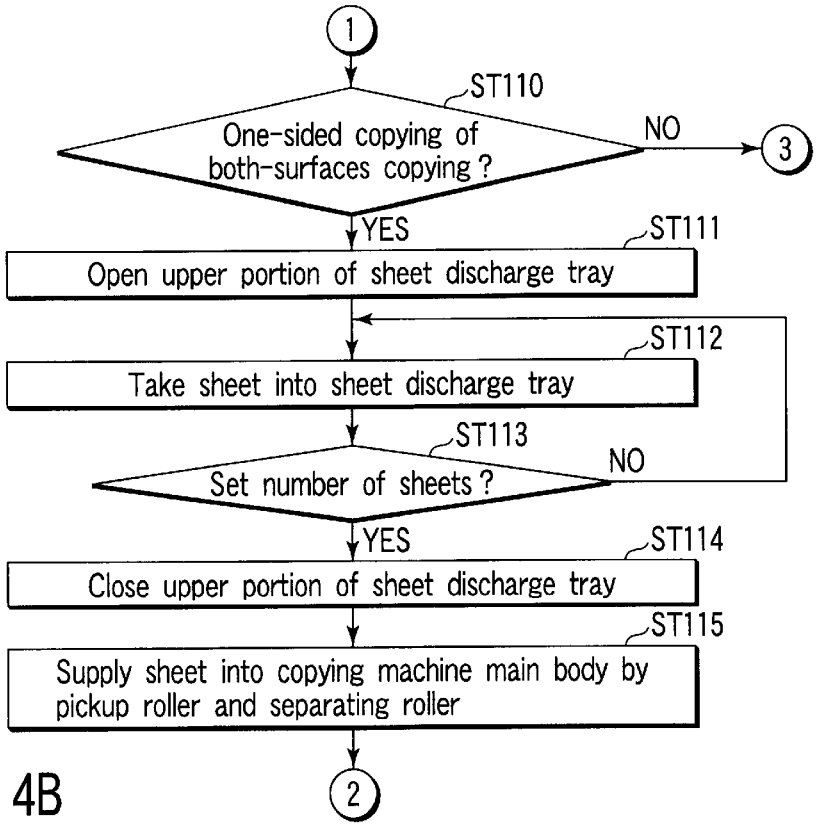

In FIG. 12, since the operation for the both-surfaces copying (in the case in which NO is judged in step ST305) is the same as that of the sheet discharge tray 2 of the first embodiment of FIG. 4B, description thereof is omitted. During sorting (in the case of YES in step ST306 of FIG. 12), the sheet 100 is not discharged to the sheet discharge tray 2, guided by a conveying roller 420, and discharged onto the bin of each stage of the bins 410.

Figure 13A:
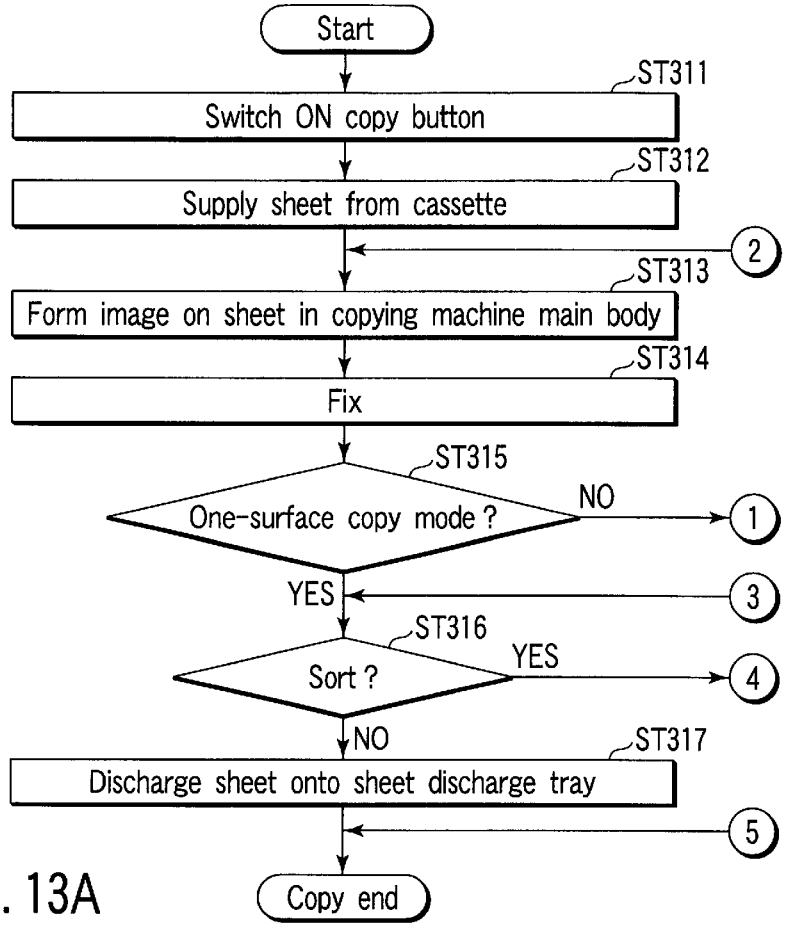
FIGS. 13A, 13B are flowcharts showing the operation of the apparatus shown in FIG. 11.

FIG. 11 shows a constitution in which the bin 410 of the sorter 400 moves vertically, and the sheet is guided to the bin of each stage of the bins 410. FIG. 13 is a flowchart showing the operation of the apparatus of FIG. 11.

Figure 11B:
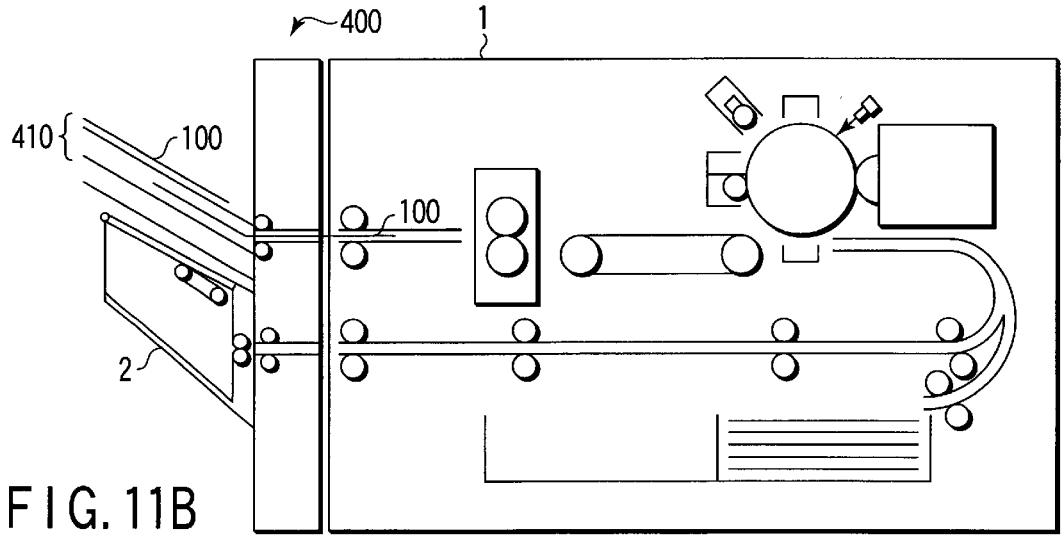
Figure 13B:
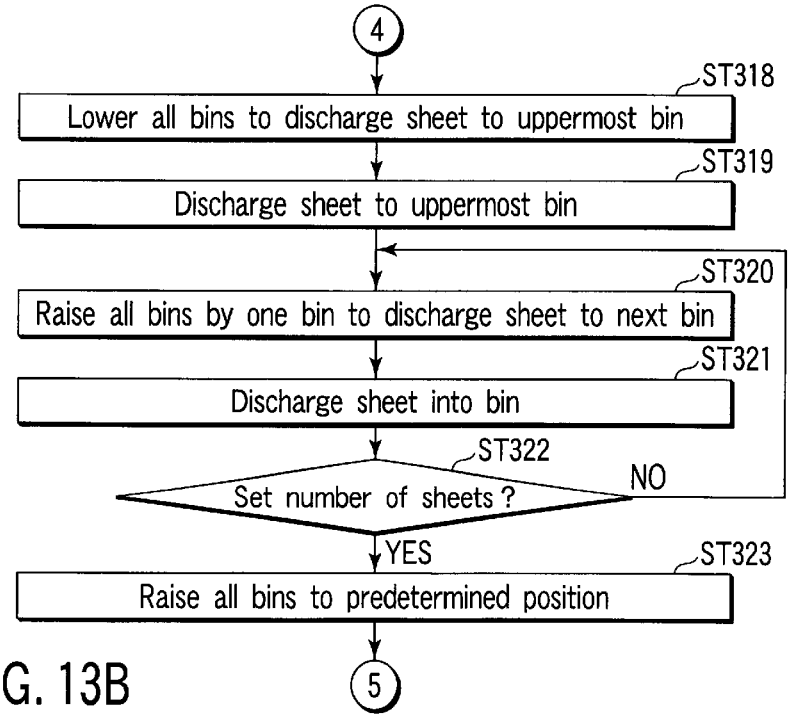

Since the operation for the both-surfaces copying is the same as that of the first embodiment of FIG. 4B similarly as FIG. 12, description thereof is omitted. During sorting (in the case of YES in step ST316 of FIG. 13A), as shown in FIG. 13B, the sheet 100 is not discharged to the sheet discharge tray 2, guided to the bin of each stage by raising/lowering the bin 410, and discharged (ST318 to 323). FIG. 11B shows a state in which the sheet 100 having one surface printed in the one-surface mode, or the sheet 100 having opposite surfaces printed in the both-surfaces copy mode is guided to the bin of each stage.

A fourth embodiment of the present invention will next be described.

Figure 14A:
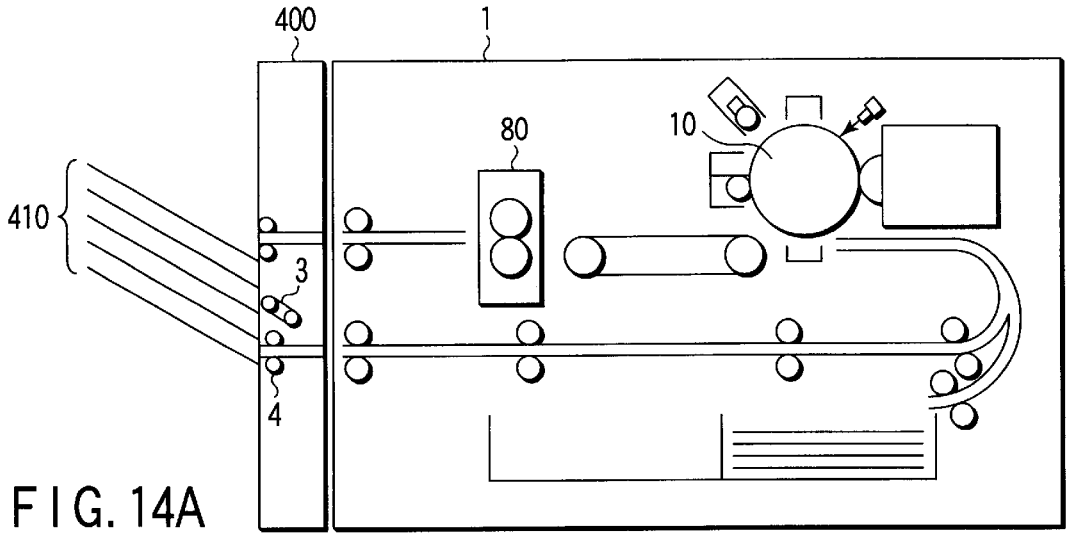
FIGS. 14A to 14C are diagrams showing a constitution of the copying machine including a sorter to which the present invention is applied.

A constitution in which the sheet having one surface with the image formed thereon inside the apparatus is once discharged to the outside of the apparatus in order to form the image on the opposite surfaces of the sheet is not limited to the aforementioned constitution in which the sheet is discharged to the sheet discharge tray 2. The copying machine with the sorter attached thereto may have a constitution in which the sheet is discharged to the bin 410 of the sorter (finisher) 400 shown in FIG. 14. In this case, the bin 410 functions as the sheet discharge tray 2. The bin 410 of the sorter 400 moves vertically, and the sheet is guided to the bin of each stage. The pickup roller 3 and separating roller 4 are incorporated in the sorter 400. FIG. 14A shows sheet discharge in a case in which the sheets are not sorted in the usual copying (in the one-surface mode), and the sheet 100 having one surface copied is discharged to the uppermost bin of the bins 410.

Figure 14B:
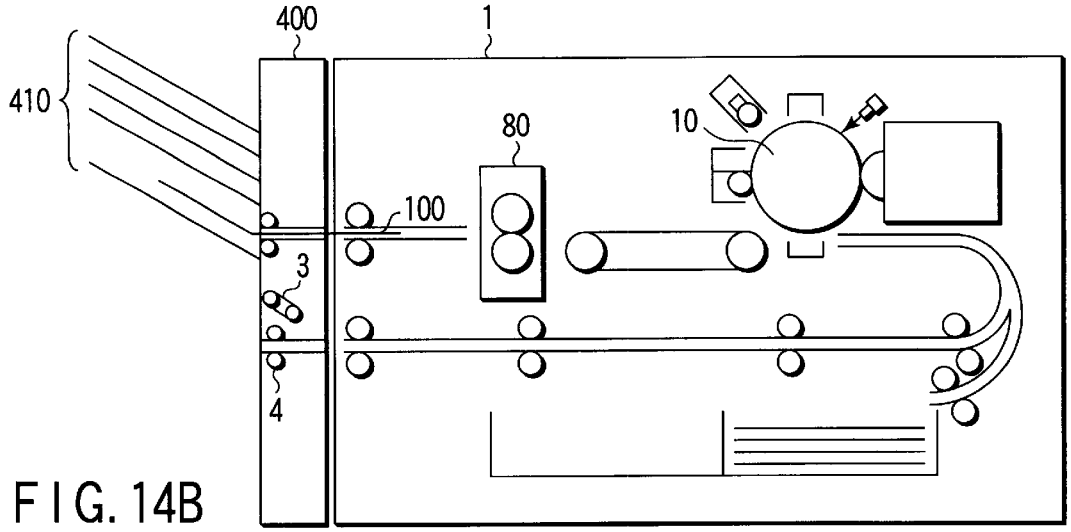

FIG. 15 is a flowchart showing the operation of the apparatus of FIG. 14 according to a fourth embodiment. As shown in FIG. 15A, when the copy button is depressed, the sheets 100 are supplied from the cassette 90 sheet by sheet so as to match the position of the toner image formed on the photosensitive body 10, and guided to the photosensitive body 10 (ST331, 332). Subsequently, the toner image formed on the photosensitive body 10 is transferred to the sheet 100, and fixed onto the sheet 100 by the fixing unit 80 (ST333, 335). When both-surfaces copying is set (NO in the step ST335), the bin 410 moves upwards as shown in FIG. 14B, and the sheet 100 is taken into the lowermost bin 410 (discharged) (ST339 to 341 of FIG. 15B).

When the set sheets 100 are all discharged, the bin 410 descends to the position shown in FIG. 14A, and the pickup roller 3 moves to a side of the bin 410 from the sorter 400 (ST343, 344). The sheets 100 are fed sheet by sheet into the copying machine 1 main body by the pickup roller 3 and separating roller 4 so as to match the position of the toner image formed on the photosensitive body (ST345). When the set number of sheets 100 are all supplied into the main body, the pickup roller 3 and separating roller 4 are contained in the copying machine main body (ST346, 347).

Figure 15A:
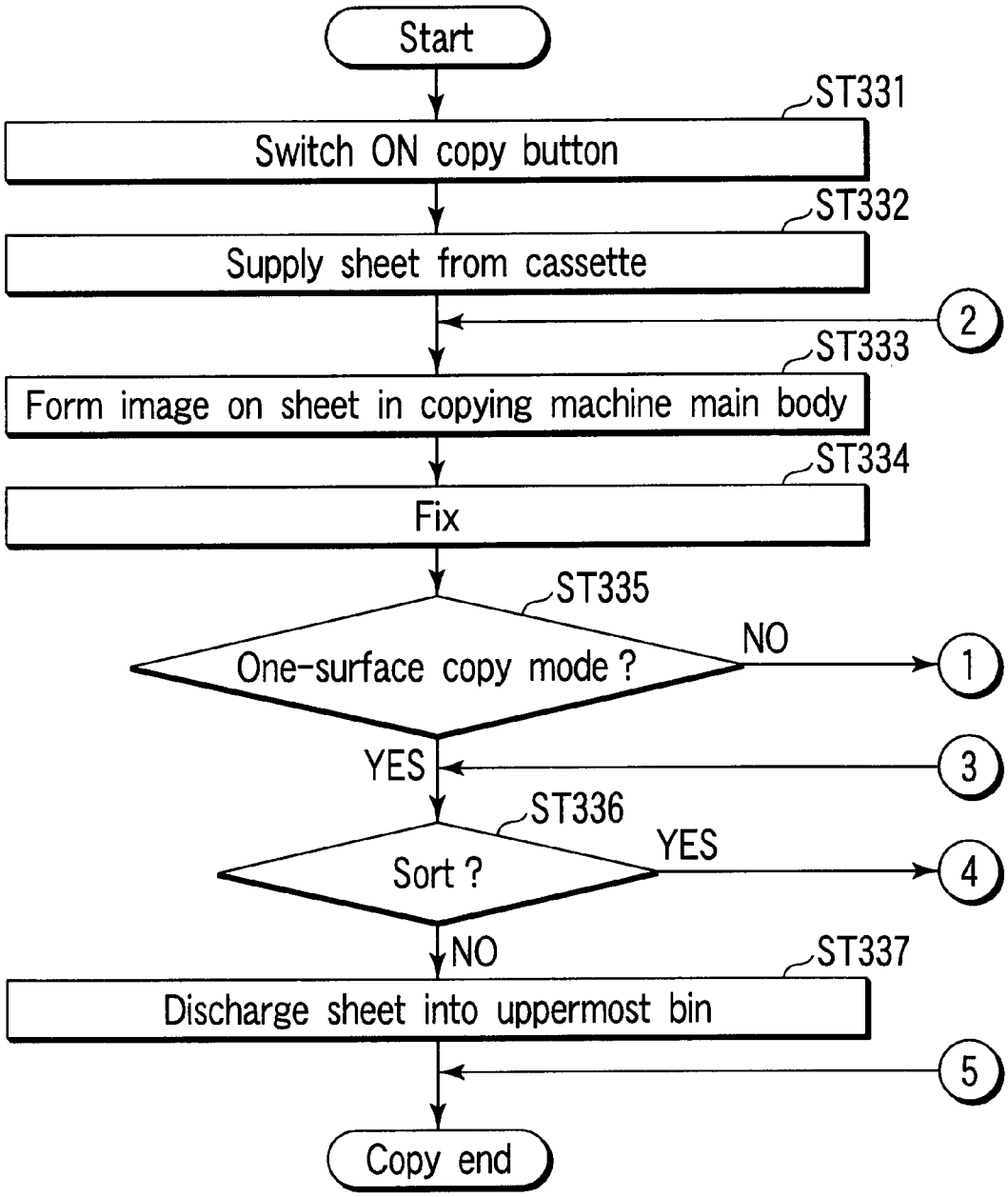
FIGS. 15A to 15D are flowcharts showing the operation of the apparatus of FIG. 14 according to a fourth embodiment.
Figure 15B:
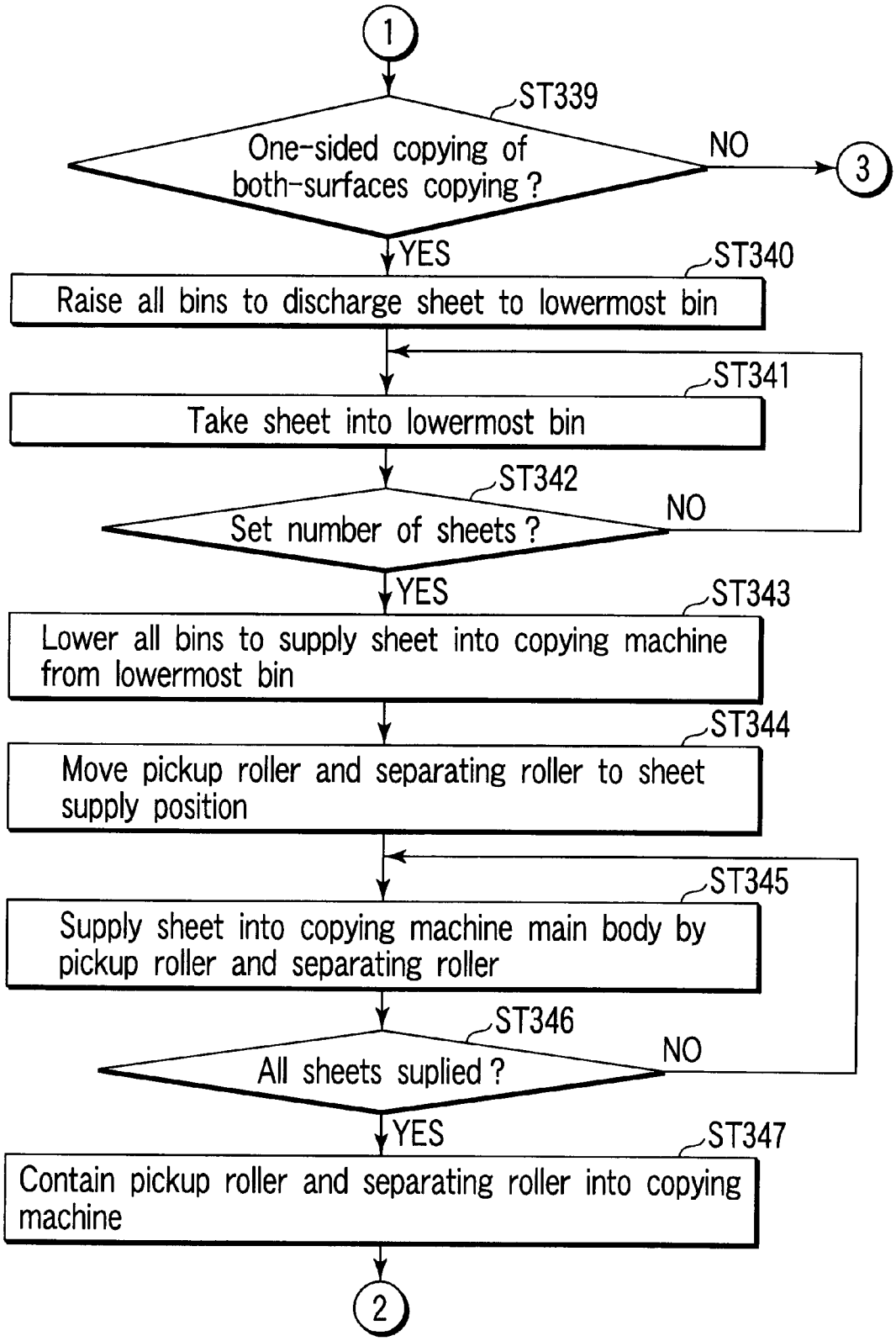
Figure 15C:
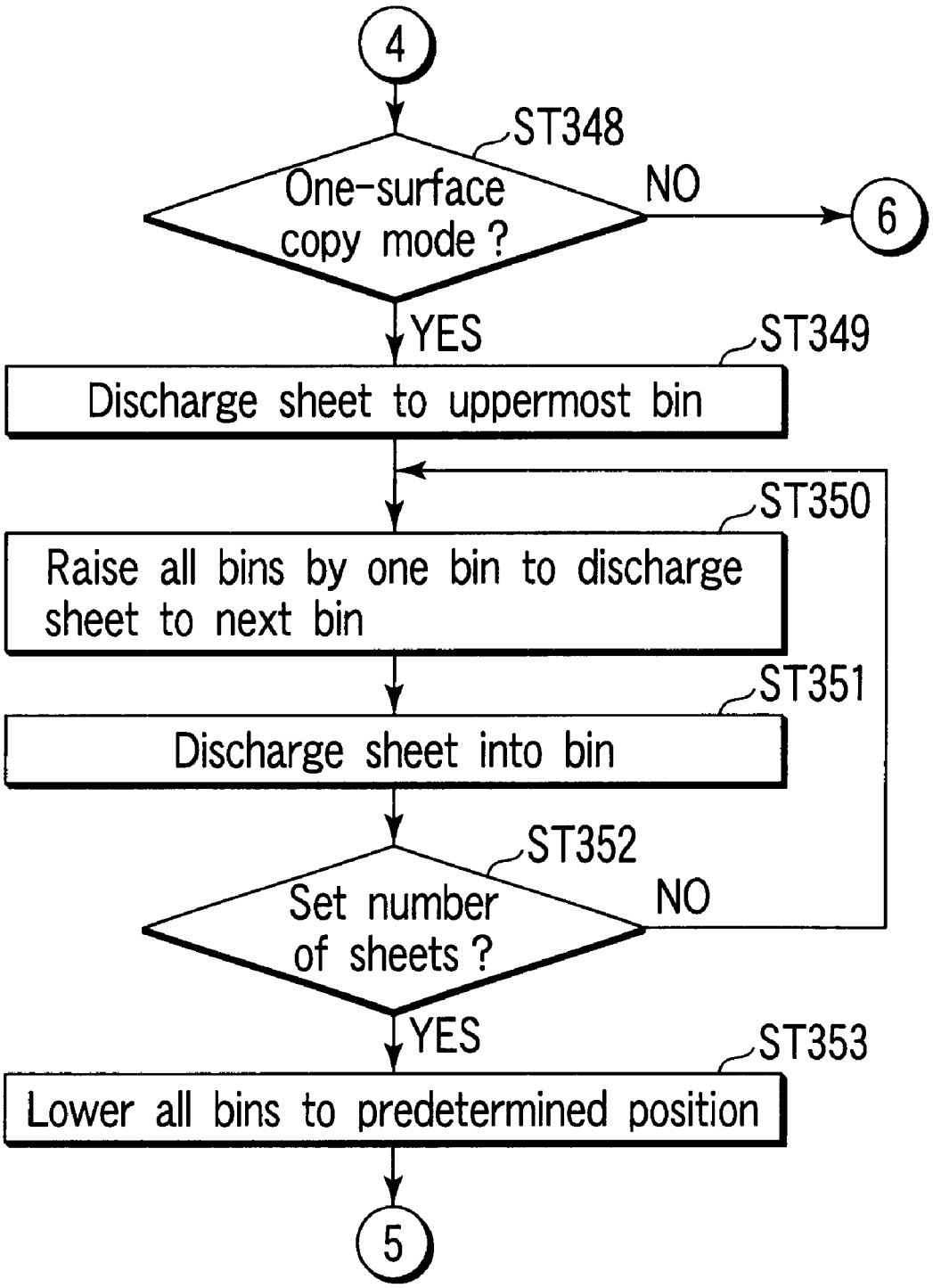

For the sheet 100 fed to the photosensitive body 10, as shown by the steps ST333, 335 of FIG. 15A, the toner image formed on the photosensitive body 10 is transferred to the non-copied opposite surface, and fixed by the fixing unit 80. When a sort mode is not set (NO in the step ST336), the sheet 100 having the opposite surfaces copied is discharged to the uppermost bin (ST337).

When the sort mode is set (YES in the step ST336 of FIG. 15A), and the one-surface copy mode is set (YES in the step ST348 of FIG. 15C), as shown in the steps ST349 to 352, a first sheet is discharged to the uppermost bin of the bins 410 disposed in the position of FIG. 14A. Thereafter, the bins 410 rise stage by stage for each sheet, and each sheet is discharged to the bin of each stage. When the set number of sheets are discharged to each bin, the bin 410 is lowered to a predetermined position shown in FIG. 14A (ST353).

Figure 15D:
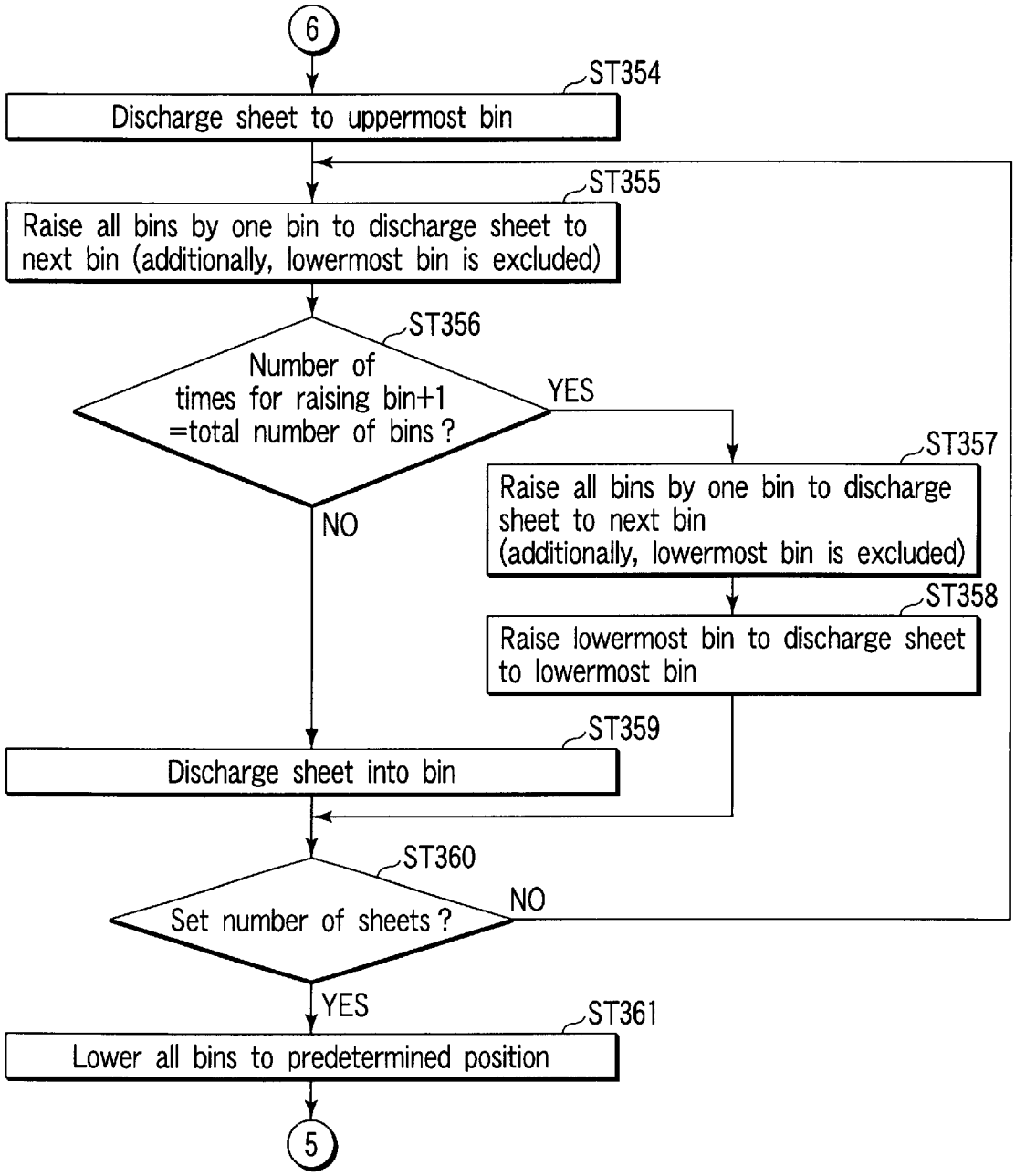
Figure 16:
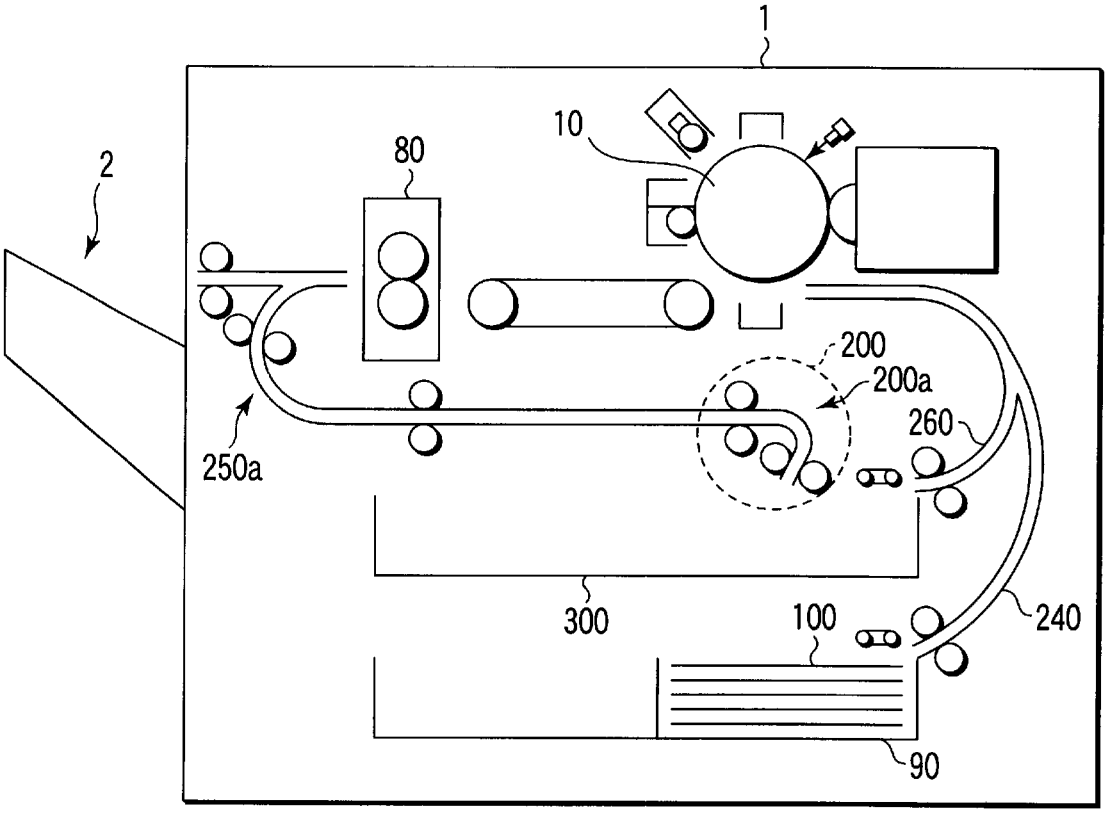
FIG. 16 PRIOR ART
FIG. 16 is a diagram showing a constitution of a conventional copying machine.

When the sort mode is set (YES in the step ST336 of FIG. 15A), and the both-surfaces copy mode is further set (NO in the step ST348 of FIG. 15C), the flow shifts to FIG. 15D. FIG. 15D shows another example of a sort mode operation.

Figure 14C:
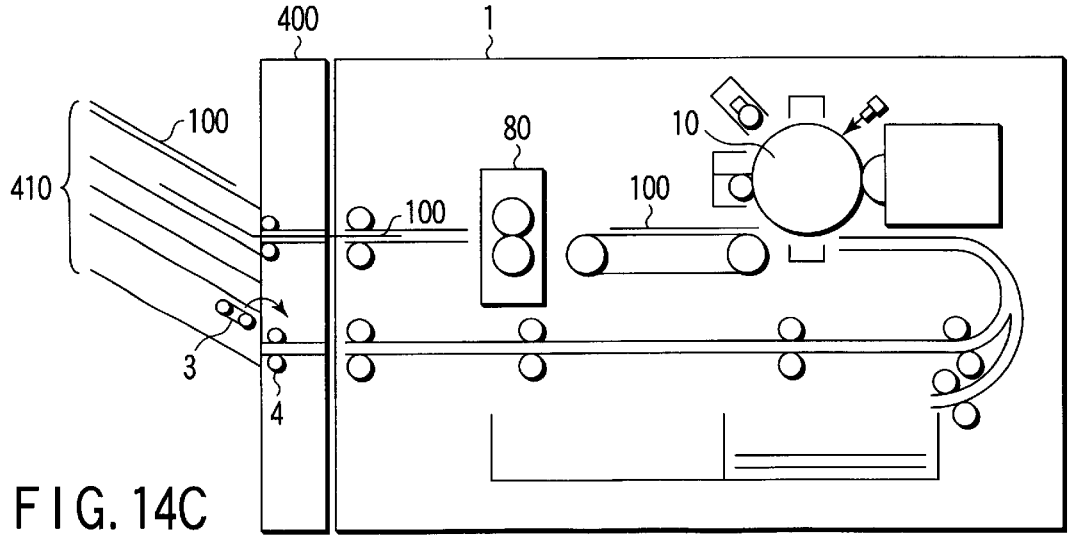

The sheet 100 having the images formed on the opposite surfaces thereof is discharged to the uppermost bin of the bins 410 in the position of FIG. 14A in a step ST354 of FIG. 15D. Subsequently, each-stage bin 410 excluding the lowermost bin rises for each sheet, and each sheet is discharged to each bin (ST355, 356, 359, 360). FIG. 14C shows this state. However, the number of times at which the bin 410 is raised with 1 added thereto agrees with the total number of bins (YES in the step ST356). Then, the sheet is discharged to the lowermost bin (ST357, 368). Finally, the bin 410 is lowered to the predetermined position shown in FIG. 14A (ST361).

An example in which the present invention is applied to a digital copying machine has been described. The present invention can be applied not only to the digital copying machine but also to an analog copying machine. It is apparent for a person skilled in the art that the present invention can be applied to various copying machines regardless of whether color or black-and-white.

What is claimed is:

1. An image forming apparatus including an apparatus main body having an image forming section, and a sheet discharge tray disposed outside the apparatus main body, said apparatus comprising:

a first image forming unit which uses said image forming section to form an image on one surface of a sheet;

a first sheet discharge section which discharges the sheet with the image formed thereon by said first image forming unit to said sheet discharge tray;

a sheet supply section which supplies said sheet discharged to said sheet discharge tray by said sheet discharge section into said apparatus main body;

second image forming unit which uses said image forming section to form an image on another surface of said sheet supplied by said sheet supply section; and a second sheet discharge section which discharges the sheet with images formed on both surfaces thereof by the first and second image forming units to the sheet discharge tray.

2. An image forming apparatus including an apparatus main body having an image forming section, and a sheet discharge tray disposed outside the apparatus main body, said apparatus comprising:

a first image forming unit which uses said image forming section to form an image on one surface of a sheet;

a first sheet discharge section which discharges the sheet with the image formed thereon by said first image forming unit to said sheet discharge tray;

a sheet supply section which supplies said sheet discharged to said sheet discharge tray by said sheet discharge section into said apparatus main body; and second image forming unit which uses said image forming section to form an image on another surface of said sheet supplied by said sheet supply section, wherein said sheet discharge tray includes a sheet storage section and a lid which is disposed in an upper portion of the sheet storage section and opens/closes centering on one shaft, said lid closes in a one-surface copy mode, said sheet is discharged to an upper portion of the lid, said lid opens in a both-surfaces copy mode, and said sheet is discharged into said storage section.

3. An image forming apparatus including an apparatus main body having an image forming section, and a sheet discharge tray disposed outside the apparatus main body, said apparatus comprising:

a first image forming unit which uses said image forming section to form an image on one surface of a sheet;

a first sheet discharge section which discharges the sheet with the image formed thereon by said first image forming unit to said sheet discharge tray;

a sheet supply section which supplies said sheet discharged to said sheet discharge tray by said sheet discharge section into said apparatus main body; and second image forming unit which uses said image forming section to form an image on another surface of said sheet supplied by said sheet supply section, wherein said sheet discharge tray has a box-shaped sheet receiving section which has at least a side surface opened on a side of said apparatus main body and rotates centering on one shaft, and said box-shaped sheet receiving section is set in a first position rotated in one direction by a predetermined angle in a one-surface copy mode, and set in a second position rotated in the other direction by said predetermined angle to receive said sheet discharged by said sheet discharge section in a both-surfaces copy mode.

4. An apparatus according to claim 1, wherein said sheet discharge tray has upper and lower sheet storage sections, and a guide for guiding said sheet to one of said upper and lower sheet storage sections, said guide guides said sheet to said upper sheet storage section in a one-surface copy mode, and said guide guides said sheet to said lower sheet storage section in a both-surfaces copy mode.

5. An apparatus according to claim 1, further comprising a moving section which moves said sheet discharge tray, wherein the moving section moves said sheet discharge tray to a sheet discharge position when said sheet discharge section discharges said sheet, and moves said sheet discharge tray to a sheet supply position when said sheet supply section supplies said sheet to said apparatus main body.

6. An apparatus according to claim 1, wherein said sheet supply section includes a pickup roller and a separating roller for taking out said sheet discharged into said sheet discharge tray.

7. An image forming apparatus including an apparatus main body having an image forming section, and a sorter which has a plurality of stages of bins and which is disposed outside the apparatus main body, said apparatus comprising:

a first image forming unit which uses said image forming section to form an image on one surface of a sheet;

a first sheet discharge section which discharges the sheet with the image formed thereon by said first image forming unit to the bin of a predetermined stage among said plurality of stages;

a sheet supply section which moves a position of the bin of said predetermined stage to which said first sheet is discharged by said first sheet discharge section to a sheet supply position, and supplies said sheet into said apparatus main body;

a second image forming unit which uses said image forming section to form an image on the other surface of said sheet supplied by said sheet supply section; and a second sheet discharge section which discharges the sheet with images formed on both surfaces thereof by the first and second image forming means to any one of said plurality of stages of the bins.

8. An apparatus according to claim 7, wherein said sheet supply section is disposed in said sorter.

9. The apparatus according to claim 8, wherein said sheet supply section includes a pickup roller and a separating roller for taking out said sheet discharged to the bin of said predetermined stage.

10. An image forming method applied to an image forming apparatus including an apparatus main body having an image forming section, and a sheet discharge tray disposed outside the apparatus main body, said method comprising:

using said image forming section to form an image on one surface of a sheet;

discharging the sheet with the image formed thereon by said first image forming means to said sheet discharge tray;

supplying said sheet discharged to said sheet discharge tray into said apparatus main body;

using said image forming section to form an image on the other surface of said supplied sheet; and discharging the sheet with images formed on both its surfaces to the sheet discharge tray.

11. An image forming method applied to an image forming apparatus including an apparatus main body having an image forming section, and a sheet discharge tray disposed outside the apparatus main body, said method comprising:

using said image forming section to form an image on one surface of a sheet;

discharging the sheet with the image formed thereon by said first image forming means to said sheet discharge tray;

supplying said sheet discharged to said sheet discharge tray into said apparatus main body; and using said image forming section to form an image on the other surface of said supplied sheet, wherein said sheet discharge tray includes a sheet storage section and a lid which is disposed in an upper portion of the sheet storage section and opens/closes centering on one shaft, and said method further comprises:

closing said lid so that said sheet is discharged to an upper portion of said lid in a one-surface copy mode; and opening said lid so that said sheet is discharged into said storage section in a both-surfaces copy mode.

12. An image forming method applied to an image forming apparatus including an apparatus main body having an image forming section, and a sheet discharge tray disposed outside the apparatus main body, said method comprising:

using said image forming section to form an image on one surface of a sheet;

discharging the sheet with the image formed thereon by said first image forming means to said sheet discharge tray;

supplying said sheet discharged to said sheet discharge tray into said apparatus main body; and using said image forming section to form an image on the other surface of said supplied sheet, wherein said sheet discharge tray has a box-shaped sheet receiving section which has at least a side surface opened on a side of said apparatus main body and which rotates centering on one shaft, and said method further comprises:

setting said box-shaped sheet receiving section in a first position rotated in one direction by a predetermined angle in the one-surface copy mode; and setting the box-shaped sheet receiving section in a second position rotated in the other direction by said predetermined angle to receive said sheet discharged by said sheet discharge section in a both-surfaces copy mode.

13. An apparatus according to claim 10, wherein said sheet discharge tray has upper and lower sheet storage sections, and a guide which rotates centering on one shaft in order to guide said sheet to one of said upper and lower sheet storage sections, said guide is set in a position rotated in one direction so that said sheet is guided to said upper sheet storage section in a one-surface copy mode, and said guide is set in a position rotated in the other direction in order to guide said sheet to said lower sheet storage section in a both-surfaces copy mode.

14. An method according to claim 10, further comprising:

moving said sheet discharge tray to a sheet discharge position, when said sheet is discharged by said sheet discharge step, and moving said sheet discharge tray to a sheet supply position, when said sheet is supplied into said apparatus main body by said sheet supply step.

* * * * *